United States Patent [19]

Fekete, Sr.

[11] Patent Number: 5,025,505

[45] Date of Patent: Jun. 25, 1991

[54] ADJUSTABLE-FIT FLAT-TOP HAT

[76] Inventor: Joseph Fekete, Sr., c/o Virginia Garment Co., Inc., P.O. Box 2029, Richmond, Va. 23216

[21] Appl. No.: 548,503

[22] Filed: Jul. 2, 1990

Related U.S. Application Data

[63] Continuation-in-part of Ser. No. 344,986, Apr. 28, 1989.

[51] Int. Cl.[5] ..... A42B 1/02

[52] U.S. Cl. ..... 2/197

[58] Field of Search ..... 2/171.1, 171.4, 171.5, 2/171.6, 171.7, 171.8, 209.3, 209.4, 175, 177, 178, 179, 185 R, 185 C, 190, 191, 195, 197, 199

[56] References Cited

U.S. PATENT DOCUMENTS

| | | | |
|---|---|---|---|
| 1,399,726 | 12/1921 | Werner | 2/197 |
| 1,663,124 | 3/1928 | Fischer | 2/197 |
| 1,805,522 | 5/1931 | Horos | 2/197 |
| 2,106,570 | 1/1938 | Lipton | 2/197 |
| 2,458,275 | 1/1949 | Kriebel | 2/197 |
| 2,556,807 | 6/1951 | Goldman | 2/197 |
| 2,759,191 | 8/1956 | Berg | 2/197 |
| 3,737,918 | 6/1973 | Henschel | 2/197 |
| 4,468,815 | 9/1984 | Pellegri | 2/197 |
| 4,815,148 | 3/1989 | Satterfield | 2/197 |

FOREIGN PATENT DOCUMENTS

| | | | |
|---|---|---|---|
| 567143 | 5/1958 | Belgium | 2/197 |
| 141856 | 8/1930 | Fed. Rep. of Germany | 2/197 |
| 201049 | 7/1923 | United Kingdom | 2/197 |
| 1019556 | 2/1966 | United Kingdom | 2/197 |

*Primary Examiner*—Werner H. Schroeder
*Assistant Examiner*—Diana L. Biefeld
*Attorney, Agent, or Firm*—William T. Hough

[57] ABSTRACT

An adjustable-fit flat-top hat having two separate rearwardly positioned spaced-apart reverse foldable rim portions each with intermittently detachable and securable mating mechanism inclusive of a common intermediate anchoring element as a part of the entire mating and securing mechanism, with the common anchoring element being mounted on an rearwardly positioned intermediate hat rim portion positioned within a gap between rearwardly positioned opposite ends of the discontinuous hat band, and spaced-apart parallel stitching securing together circumscribing edges of the hat's flat crown top and crown rim upper edge, typically utilizing opposing male hook and female loops elements as a part of the securable mating mechanism.

12 Claims, 5 Drawing Sheets

FIG. 1B
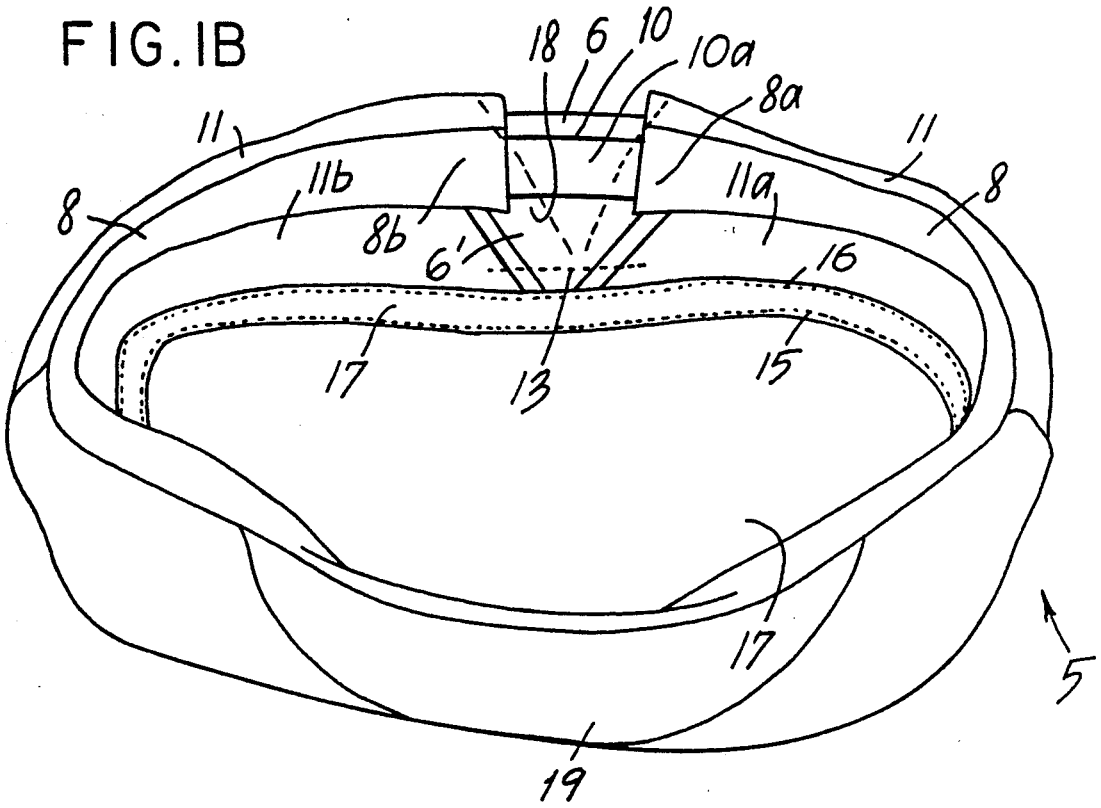
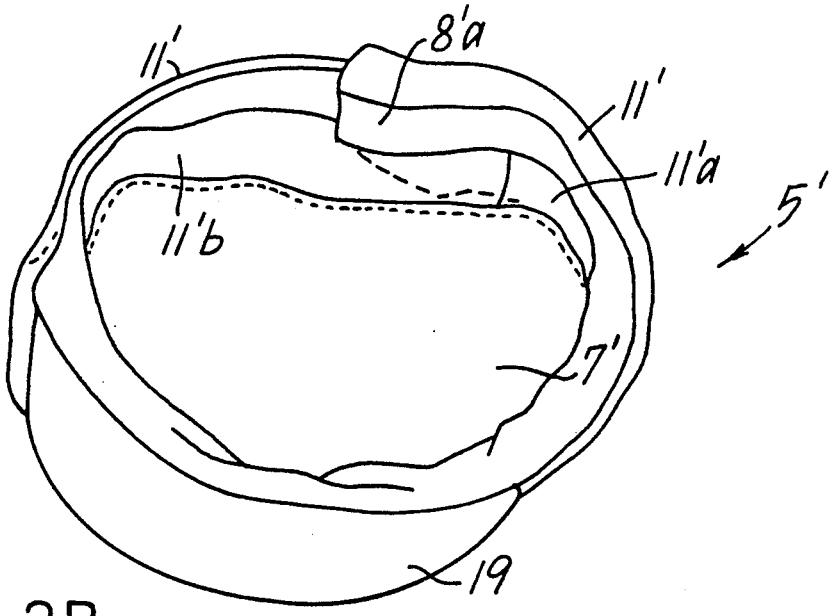
FIG. 2B

FIG. 1E
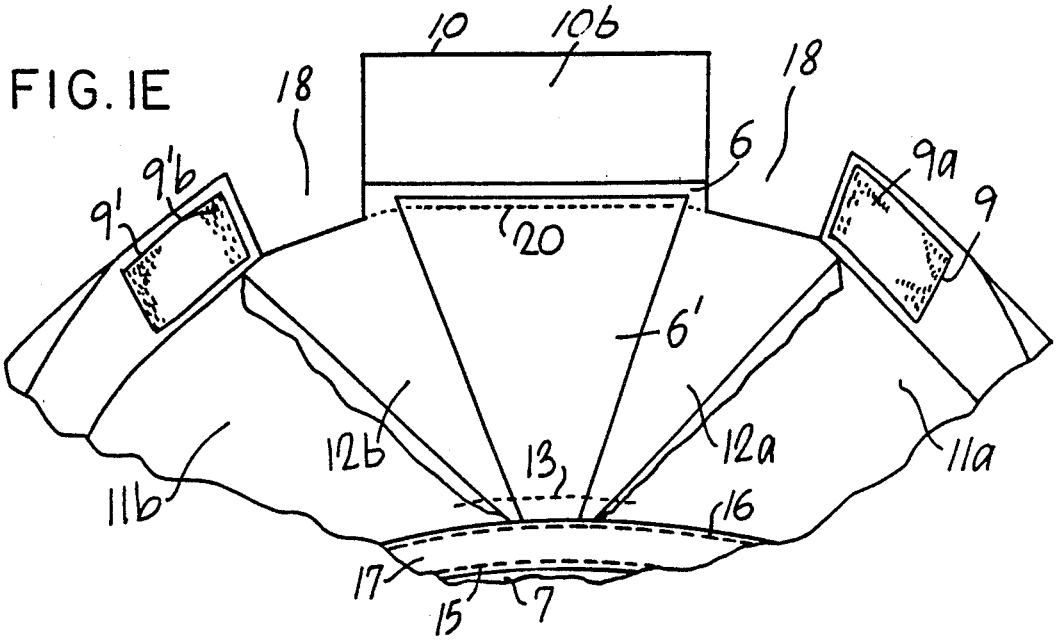
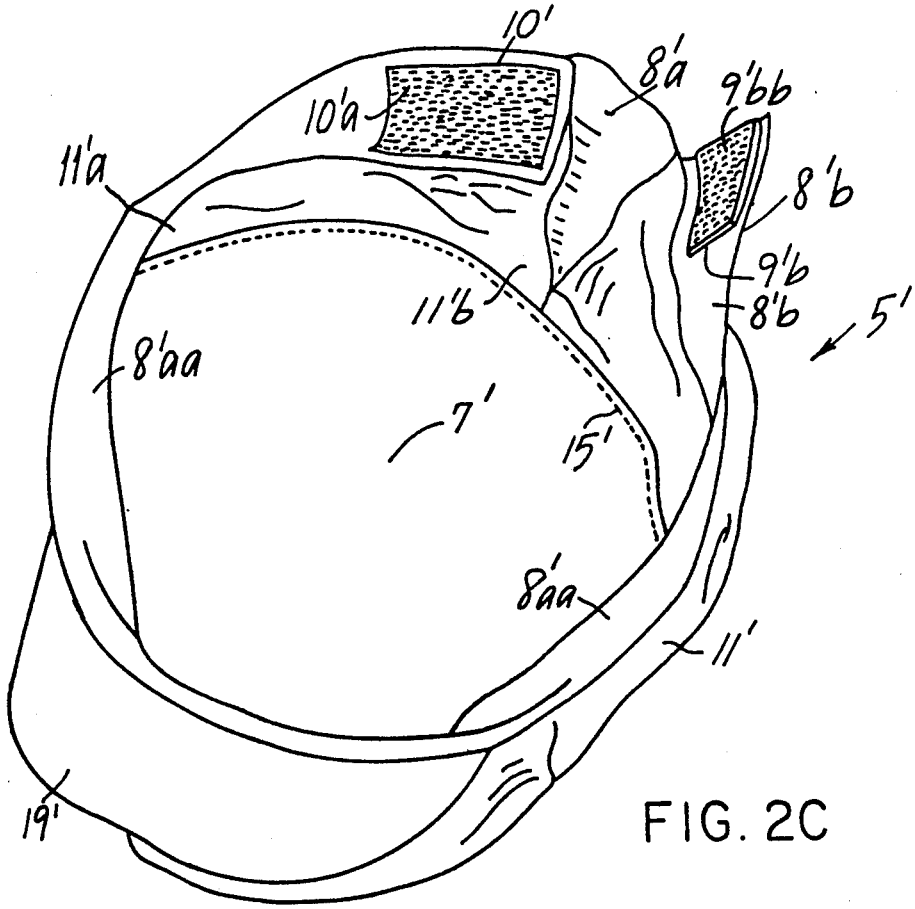
FIG. 2C

ADJUSTABLE-FIT FLAT-TOP HAT

This is a continuation-in-part of the U.S. patent application Ser. No. 07/344,986 filed Apr. 28, 1989 for an Adjustable-fit Hat.

The present invention is directed to an enhanced related improved different adjustable-fit flat-top hat.

PRIOR ART

In view of the substantial and major differences in the mechanism and structure and advantages of the present invention, as compared to the above-noted invention of the parent application, there is no known relevant prior art. Art of interest considered to be non-analagous and non-teaching, includes the U.S. Pat. No. 1,663,124 to Fischer issued March 1928 and U.S. Pat. No. 4,815,148 to Satterfield issued March 1987. None of the prior art patents are directed to formally-appearing sport-dress type flat-top hats and problems/difficulties associated therewith and none of the prior art patent have a unitary single combination embodying multiple separate rearwardly-positioned spaced-apart head-fitting adjustment mechanism that involves a common anchoring element and operatively requiring the presence of an intermediate band-gap involving a band that functions by virtue of having to fold inwardly while concurrently obtaining a totally closed heretofore through-space hole/opening of visibly exposed rim portions. The Fischer patent factually discloses solely far-apart folded creases for a bandless hemispherically ovally-rounded crown-type hat involving a folding of the entire crown top and rim thereof. The Satterfield patent discloses a substantially hemispherically-shaped crown for a now-formal type or non-dressy type cap and having nothing more than a velcro-like fastener for spaced-apart edges of a crown including a slit extending through well upwardly into the hat's rim.

BACKGROUND TO THE INVENTION

Prior to the present invention, formally-appearing dressy-type flat-top hats or caps to which the present invention is exclusively directed, have had solely an adjustable fitting of one sort or another, which have heretofore include unsightly open through-space holes extending between an overlapping portion and an overlapped portion of the heretofore discontinuous rim portion of the hat. As a result thereof, such prior art caps/-hats have had a resulting non-fitting wrinkling and gapping-apart of these disconnected parts and have had considerable puckering in an unsightly manner; as a result thereof, the "fit" was not reliably adjustable nor snug. The prior type of adjusted flat-top hat also was not properly aligned with a resulting discomfort as well as unsightly in appearance. Such short comings heretofore reduced and often virtually destroyed any realistic utility and advantages purportedly achieved by the prior art adjustable hat or cap, the worn adjustable hat/cap having failed to holding its flat top and associated supporting rim in secure nor comfortable positions and manners, devoid of properly fitting thereof. Also, for flat-top dressy-type hats or caps having a reasonable degree of quality in the sense of having a turned-under band providing support to and as contrasted to the prior art hats having flimsy rims, there heretofore has not been a neat nor good-fitting relationship for adjustable-fit flat-top hats or caps having a turned-under supporting band because the turned-under band portion was heretofore unstable, such prior art adjustable-fit flat-top being not sewn-together and/or otherwise properly anchored, insofaras the turned-under support band that would overlap the inside of the other spaced-apart end of the discontinuous support band. The aforestated heretofore disadvantages reduced the value of the prior art adjustable flat-top dress-type hats because of their failure to properly operate or fit, as well as the resulting unacceptable unsightly appearance above-noted.

Additionally, as to the present inventors recent prior invention of the afore-mentioned parent application, while that invention constitutes a marked significant advance in the art as to quality caps and proper fitting thereof in alternative fitting for such adjustable-fit flat-top hat or cap for different head sizes, there never the less remained with that invention a twisting stress and unequal fitting on opposite sides of joined portions of the band and rim thereof as joined during adjustment to fit various head sizes. As well, the downwardly-extending seam at the normally rearwardly-positioned overlapped rim portions was slanted—i.e. normally not a vertical arrangement, and was not centered in the rear of the hat support rim, together with the resulting above-noted stress being greater in pull on one side of the cap as contrasted to an opposite other side of a flat-top hat or cap. These stresses also evidenced themselves in a wrinkling of the flat-top of the crown of the flat-top hat. In arriving at the present invention, other problems were encountered particularly with regard to distortion of the flat-top of the crown and/or its supporting rim, tending to prevent the flat-top from being a smooth even surface and tending to prevent the obtaining of equally stressed circumscribing portions of the top and of the supporting rim on which the flat-top is mounted.

OBJECTS OF THE INVENTION

Accordingly, objects of the invention include the overcoming and/or avoiding of one or more above-noted difficulties and/or disadvantages of prior-existing adjustable-fit flat-top hats or flat-top caps or flat-top head coverings of those general types discussed-above, and the present objects include the avoiding the newly confronted problems and difficulties encountered in arriving at the present invention disclosed and claimed herein.

Another object is to obtain an adjustable head flat-top covering in the nature of an adjustable-fit flat-top hat or flat-top cap, that avoids unsightly puckering of the flat-top and/or its supporting rim, that accompanies unsightly uncomfortable fitting associated with the above-noted unequally stresses encountered in working toward the present invention, and the object being to achieve closely-held neat and comfortable and equalized stresses that constitute a proper fit and acceptably-neat appearance of the over-lapped spaced-apart terminal ends of the discontinuous band and of the associated rim and flat-top portion of the adjustable-fit flat-top hat or flat-top cap in juxtaposition thereto as previously discussed-above.

Another more particular object is to obtain a multiple spaced-apart fixed reverse-direction secured portions thereof exhibiting counter-balancing and/or compensating opposite pressures and/or stresses, resulting in equalized stress, together with improved appearance and enhanced utility, such that a close, neat and non-pulling or equalized fit is obtained and experienced by the wearing in any of alternated adjusted fits for different sized heads, for adjustable-fit flat-top hat(s) or cap(s) of a dressy-type.

Another object is to obtain a fixed combination as a single unit concurrently obtaining opposite fixed reverse-direction secured states of the fabric portions of the rim at closely-associated points of securing spaced-apart portions of a turned-under hat band together with supporting hat-rim associated therewith, the band being of the type mounted on a lower edge of a circumscribing supporting rim of the adjustable-fit flat-top hat, where the crown includes the flat-top hat-top mounted on the upper circumscribing edge of the rim.

Another object is to avoid the unsightly through-space opening or hole encountered by band turn-under and adjustable-fit prior art flat-top hats and/or flat-top caps.

Another object is to obtain a modified adjustable-fit flat-top hat or flat-top cap crown-combination of supporting rim and flat-top, to embody novel structural changes better resisting distortion of shape and/or fit where such distortions normally heretofore occur in adjustable-fit flat-top hats and/or flat-top caps, in order to secure a smooth unwrinked flat-top and/or associated supporting rim thereof.

Other objects become apparent from the preceding and following disclosure.

Objects of the invention are obtained by the invention described above and hereinafter.

SUMMARY OF THE INVENTION

An adjustable-fit flat-top hat has two closely-associated rearwardly positioned spaced-apart reverse foldable rim portions foldable in opposite lateral directions along a longitudinal axis of the supporting rim (all supporting rim portions). Each of the reverse foldable rim portions have critically a common intermittently detachable and securable mating mechanism/combination inclusive of a substantially common (normally single/unitary) intermediate anchoring element as a part of the entire mating and securing combination; it should be recognized that the spirit of the invention cannot be avoided by dividing this common anchoring element into two or more "closely-associated" substantially adjacent anchoring elements. The common anchoring element is mounted on an rearwardly positioned intermediate hat rim portion positioned within a gap formed by and between rearwardly positioned spaced-apart opposite ends of the discontinuous hat band that is mounted on a lower edge of the rim; again, the spirit of the invention is included within closely-associated separate anchoring elements separated by a supplemental additional rearward rim portion, although such arrangement would not be preferred and would have diminishing benefits of the present invention as set-forth in the aforestated objects.

In the above-noted broadly-described invention, to compensate for extra stress and stretching-strain thereby resulting to the crown rim and the crown flat-top mounted on the upper edge of the rim, there is preferably are included critical spaced-apart parallel stitchings (seams of stitching) securing together circumscribing edges of the flat-top hat's/cap's crown flat-top and hat's/cap's crown rim upper edge.

While this invention is principally directed to a flat-top hat of adjustable-fit type heretofore described, together with problems and difficulties previously associated therewith, the invention in an alternate more broad statement thereof includes any adjustable hat and/or cap, insofar as the above-described multiple opposite-directions reverse folding combination, mechanisms and structures thereof coordinately functioning together to obtain equalized rim stresses on each and both opposite lateral-side rim portions of the hat or cap crown thereof.

In an alternate more preferred embodiment, the invention may be described as follows. There is provided an adjustable-fit head flat-top covering having a supporting rim thereof adjustable to fit heads of different sizes, of which the head covering includes a crown having a flat-top portion and having a substantially separate upright annular supporting rim portion, and having an inwardly-foldable hat band portion supportable of the rim portion when folded inwardly. Each of the supporting rim and the hat band are elongated along their respective longitudinal axes, to extend circumscribingly and supportingly around the lower edge of the flat-top hat or flat-top cap. The critically preferred invention embodiment must be interpreted in the light of being directed to critically the type of flat-top hat or flat-top cap necessarily and critically having this particular type of fold-under band mounted on and along a lower edge of a circumscribing supporting rim of a flat-top hat. This improvement includes in combination the above-noted rim as a rim portion forming a substantially annular rim structure having rim substantially continuous material. The rim portion includes forward, rearward and opposite lateral rim portions having a common circumscribing substantially annular lower rim edge to the annular structure and a common opposite-circumscribing substantially annular upper rim edge to the annular structure. The flat top portion is mounted on the opposite-circumscribing annular upper rim edge of the rim portion that has opposite inner and outer rim faces. The hat supporting band has opposite elongated upper and lower band edges, has opposite first and second band ends and has opposite inner and outer band faces. The elongated upper band edge is mounted on the circumscribing annular lower rim edge along the forward and opposite lateral rim portions, being mounted along less than all of rearward rim portion. Thereby the resulting combination has left a band gap between the above-noted band opposite ends whereby the hat band adapted to be turned inwardly as an inner supporting band with the inner band face directed outwardly toward the inner rim face. The above-described band gap thereby formed is located adjacent the rim that is composed of substantially continuous material. The rim portion includes a gap-positioned rim portion adjacent the above-described gap and remaining other rim portion(s) not in juxtaposition to the above-described gap. The gap-positioned rim portion has its lower rim edge adjacent the gap. The substantially annular rim structure includes two separate first and second spaced-apart reverse-direction combinations and structures thereof each having first and second reverse-direction ends and the first reverse-direction end of each of the first and second spaced-apart reverse-direction combinations, mechanisms and structures thereof at spaced-apart locations rearwardly positioned at opposite sides of the gap, adjoining the remaining rim portion. An intermediate rim portion has opposite rim portion first and second lateral edges and opposite intermediate-portion inner and outer faces thereof, with the first lateral edge joining one of the second reverse-direction ends and with the second lateral edge joining a remaining other of the second reverse-direction ends. Each of the first and second spaced-apart reverse-direction combination/-mechanisms and structures thereof include hinge-like structures/mechanism consecutively at spaced-apart predetermined optionally alternate locations for inwardly-folding the annular rim structure upon itself. As a result thereof, wearing size of the crown may is optionally folded to fit alternate sizes of heads. Additionally there is provided/included a first and at-least two second mating combination/mechanism and structure thereof detachably mating of the first mating combination mechanism and structure thereof with the two second mating combination/mechanism and structure thereof. The first mating combination has a first mating face, and each second mating combination has a second mating face. The first mating combination is positioned and mounted on the intermediate portion positioned and one of the second mating faces is mounted on the first band end and remaining other second mating faces are mounted on the second band end. As a result of such arrangement, the first mating combination is intermittently detachably mateable with each of the two second mating combinations when the band portion is inwardly turned to its rim-supporting position. Thereby the crown is securable at any of alternate head sizes when adjusted by either or both of the first and second spaced-apart reverse-direction combinations and thereby opposite sides of the crown critically are evenly stretched/stressed and positioned to secure improved fitting and appearance when worn.

In a preferred embodiment, critically one of the first and second mating combination includes loop-like elements, and critically the remaining one of the first and second mating combination includes hook-like elements detachably adapted for hooking into the loop-like elements, critically essential for securing this embodiment's preferred position and resulting proper fitting, feel (to the wearer) and neat aligned appearance for adjustable-fit formally-appearing dressy-type flat-top hat or flat-top cap of the present invention, to secure the advantages of this particular preferred embodiment.

In another preferred embodiment, there is included a visor element attached fixedly to and extending from the lower rim edge, critically necessary and a part of a formally-appearing dressy-type flat-top hat or flat-top cap of the present invention.

In another preferred embodiment, the rim portion in juxtaposition to the gap(s) is/are folded in each of opposite laterally reverse opposite directions onto itself and secured in reverse-direction folded positions and states, critically essential to be in opposite directions for the preferred benefits of this embodiment, in equaling stresses in opposite lateral directions extending axially along the rim portion.

In another preferred embodiment, there is critically provided a continuing line of junction of the flat-top portion and the opposite-circumscribing annular upper rim edge and including on opposite sides of the line of junction, spaced-apart parallel stitching having separate stitching such that critically the flat-top portion and ri portion retain predetermined supported shape and position before and after and during adjustments of head-size by alternate positioning during use of the first and second mating combination.

The invention may be better understood by making reference to the following Figures.

THE FIGURES

FIG. 1A diagrammatically illustrates a rear and slightly-viewable flat-top perspective view of an upright positioned cap in a preferred embodiment of the present invention, showing in phantom lines the continuing parts within the cap's inner space.

FIG. 1B diagrammatically illustrates a front perspective view of an upside-downly positioned cap of FIG. 1, showing in phantom lines the continuing parts outside of the cap's rearward portion.

FIG. 1C diagrammatically illustrates an in-part front perspective view of the upside-down positioned cap FIGS. 1 and 2, illustrating its appearance in its rearwardly opened non-fastened (non-mated) states, but with the band in its turned-under state of being, and also showing the spaced-apart parallel stitching by which the crown's flat-top is mounted onto the upper edge of the rim portion.

FIG. 1D diagrammatically illustrates the same in-part view of and embodiment as that of FIG. 1C, except illustrating the mating elements affixed to the inside faces of the spaced-apart gap-forming band ends, showing the band ends as partially turned outwardly.

FIG. 1E diagrammatically illustrates the same in-part view of the same embodiment as that of FIG. 1D, except in enlarged view and except showing the intermediately-positioned anchoring element in an outwardly-flipped state thereby revealing details of its attachment to the gap-positioned rim portion.

FIG. 2A diagrammatically illustrates a comparable view to that of FIG. 1A, except diagrammatically illustrating the cap of the above-noted parent application.

FIG. 2B diagrammatically illustrates a comparable view to that of FIG. 1B, except diagrammatically illustrating the cap of the above-noted parent application.

FIG. 2C diagrammatically illustrates a comparable view to that of FIG. 1C, except being a full view and except diagrammatically illustrating the cap of the above-noted parent application.

FIG. 2D diagrammatically illustrates a cross-sectional view as taken along line 2D—2D of FIG. 2A of the above-noted parent application.

FIG. 3A diagrammatically illustrates a view in partial cross-sectional view of the embodiment of FIG. 1A as taken along lines 3A—3A thereof of the present invention.

FIG. 3B diagrammatically illustrates a view in partial cross-sectional view of the embodiment of FIG. 1A as taken along lines 3B—3B thereof of the present invention.

FIG. 4 diagrammatically illustrates an in-part view in cross-section of the embodiment of FIG. 1 as taken along line 4—4 thereof of the present invention.

FIG. 5 diagrammatically illustrates an in-part view in cross-section of the embodiment of FIG. 2A taken along line 5—5 of the above-noted parent invention.

DETAILED DESCRIPTION

In the description of the above figures, identical indicia will be shown for the same embodiment in different figures and similar or related indicia will be shown for different embodiments. Once described for one embodiment and figure, description of an element or feature will not be repeated for other embodiments and/or figures, except in some instances merely to add clarity and easy of understanding.

FIGS. 1A, 1B, 1C, 1D, 1E, 3A, 3B and 4 illustrate a common preferred embodiment of the present invention. Likewise, for purposes of comparison, FIGS. 2A, 2B, 2C, 2D and 5 illustrate a common embodiment of the cap of the above-noted parent application.

In FIG. 1A, there is shown a rear and in-part top perspective view of the top of the uprightly positioned cap 5 having the substantially flat top 7, the supporting rim 11, gap-located rim portion 6, other rim portion's opposite spaced-apart ends 11*a* and 11*b*, mounting stitching 17*a* and 17*b* mounting the gap-located rim portion 6 between the other rim portions's opposite ends 11*a* and 11*b*, securing-stitching 13 cummulatively binding together at the upper location all of the fabric of the gap-located rim portion 6 and the rim portion opposite ends 11*a* and 11*b*. The flat top 7 are turned-under forming seam 14 and secured to the rim 11 by each of the spaced-apart parallel stitchings 15 and 16.

FIG. 1B shows a rear and bottom perspective view of the bottom of the invertedly positioned cap 5 additionally showing the supporting band 8 with its spaced-apart ends forming a gap 18 therebetween, and the visor 19. Also shown is the supporting substantially sturdy strengthening strip 17 held by the above-noted spaced-apart parallel stitchings 15 and 16. Also shown is a portion of the mating face 10*a* of the matable member 10, the matable face 10*a* being herein illustrated as one of opposingly matable hooks-like and loop-like elements.

FIG. 1C shows a view the same as FIG. 1B, except with the opposite folding structures 12*a* and 12*b* in the opened, unfolded states, and attachments thereof together with the above-noted stitchings 17*a* and 17*b* of the gap-positioned rim portion 6, and a separate substantially rigid rim supporting fabric 6*a* covering and mounted (typically by adhesive) on the rim fabric backside (inside face) 6' as rim intermediate portion of the previously identified gap-positioned rim portion 6, the 6*a* being shown in a partial cut-away in the rim fabric 6*a*.

FIG. 1D differs from the prior FIG. 1C, in additionally showing opposite spaced-apart band ends 81 and 8*b* in a non-turned-under state as would be the situation when adjusting the hat-size, shown turned-up (for solely purposes of illustration) thereby revealing the mating tabs 9*a* and 9*a* respectively together with their attachable faces 9*aa* and 9*bb* respectively, here illustrated a typically remaining other of the hooks-matable and the loops-matable elements. The mating tabs 9*a* and 9*b* are mounted respectively on the spaced-apart band faces 8*a* and 8*b* respectively.

FIG. 1E as an enlarged in-part view, illustrates the same view as that of FIG. 1D, except showing the previously-described mating element 10 in a flipped-up state (shown thusly solely for illustrative purposes) thereby revealing the back face 10*b* thereof and the mounting stitches 20 mounting the mating element 10 on the above-identified intermediate portion 6' (see FIG. 1C) of the above-described rim portion 6.

Figure 1A:
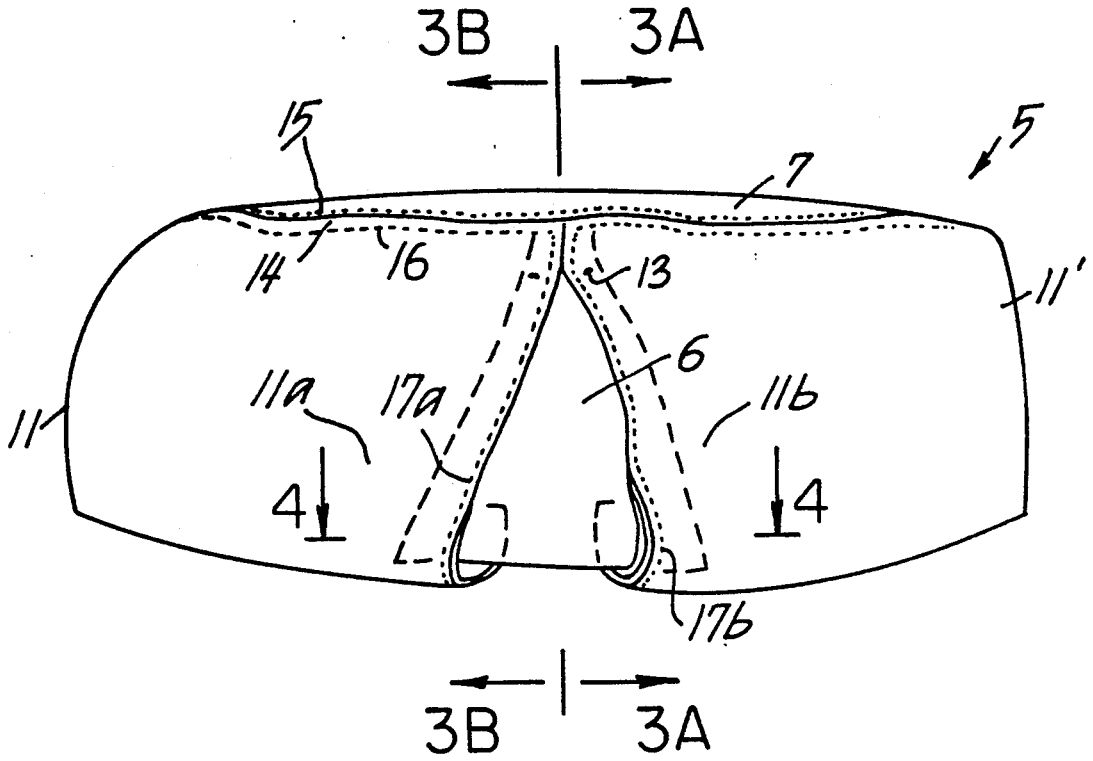
Figure 2A:
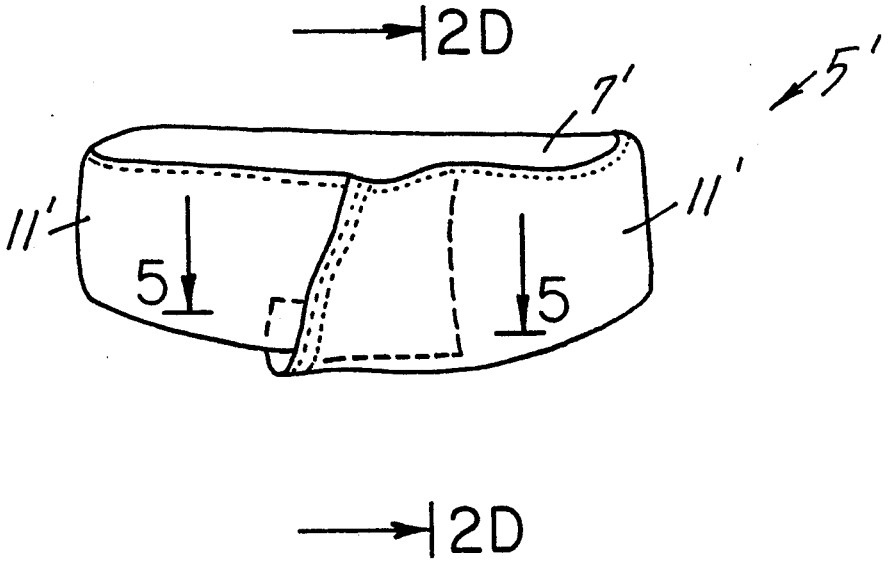
Figure 1C:
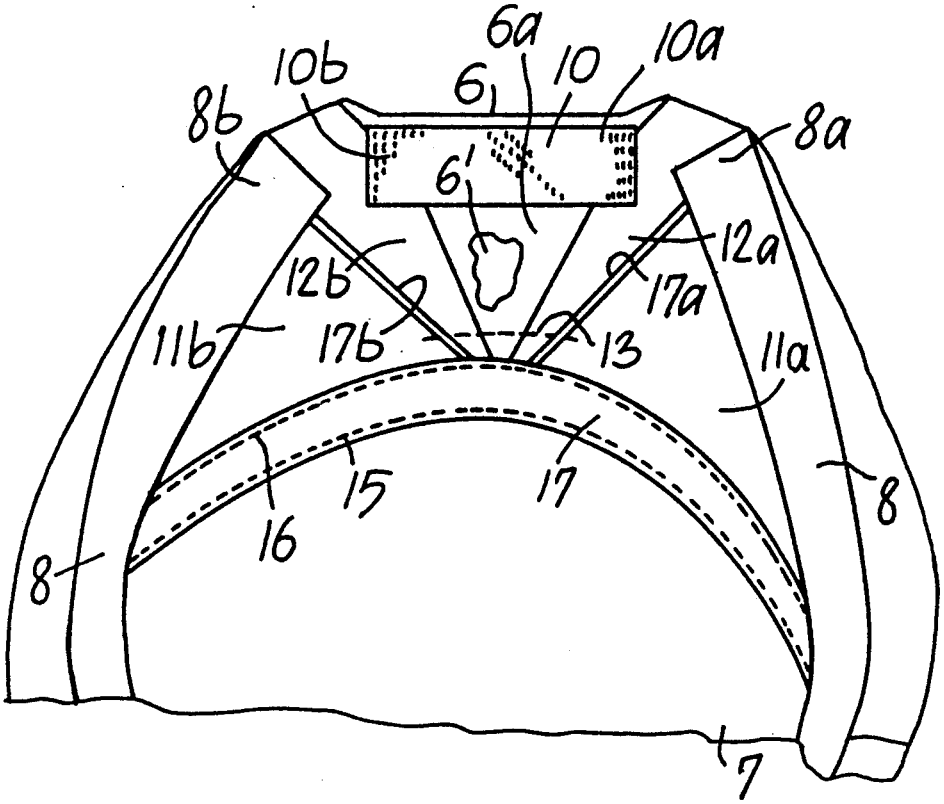
Figure 1D:
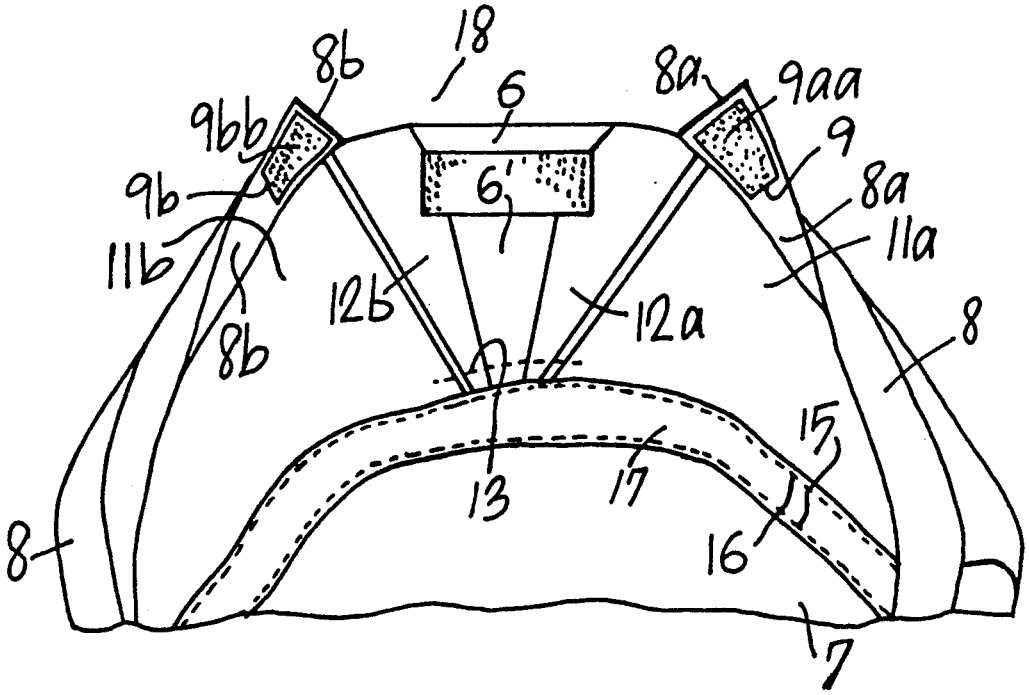
Figure 3A:
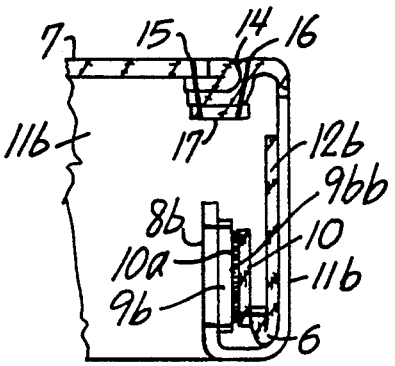
FIG. 3A illustrates a view as taken along lines 3A—3A of FIG. 1, all elements illustrated therein having been described above.
Figure 3B:
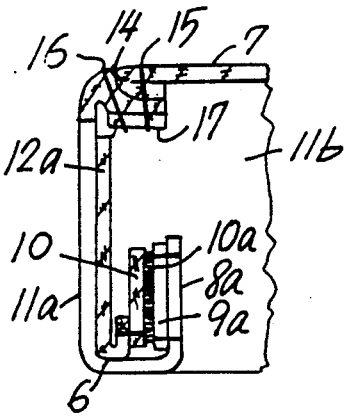
FIG. 3B illustrates a view as taken along lines 3B—3B of FIG. 1, all elements illustrated therein having been described above.
Figure 2D:
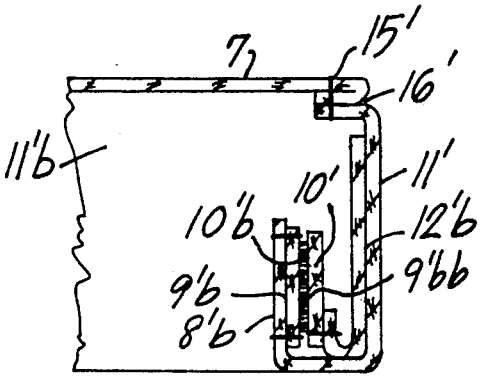
Figure 5:
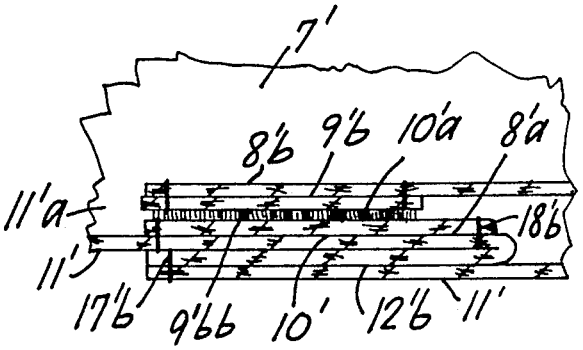
Figure 4:
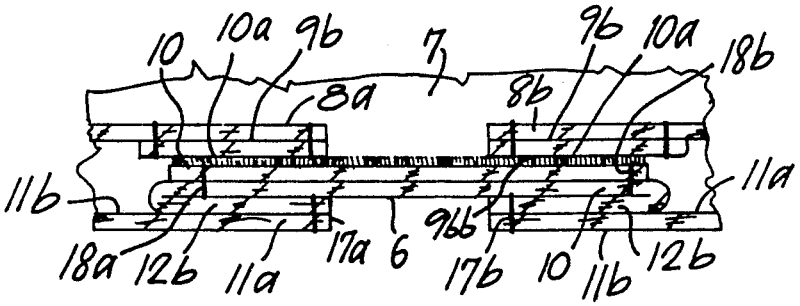
FIG. 4 illustrates a view as taken along lines 4—4 of FIG. 1, all elements illustrated therein having been described above.

In the respective FIGS. 2AA, 2B, 2C, 2D and 5, the corresponding elements are disclosed for the above-identified parent application embodiment 5' for comparison to the present invention above-described.

It is noted that in each comparative view of the present invention, it will be seen that the present invention in the illustrated embodiments, includes two oppositely operating adjustment structures and mechanisms thereof (cummulatively speaking), having a central intermediate gap-positioned rim portion of which an intermediate portion thereof mount a common mating element for each of the spaced-apart between two folding structures and folding mechanisms thereof, for attachment to each of the spaced-apart mounting elements 9*aa* and 9*bb* mounted on the spaced-apart band ends 9*a* and 9*b* respective. There is no such nor suggestive arrangement in the single-adjustment structure and mechanism thereof shown and illustrated for the above-identified parent application embodiment.

As previously state, the aforestated objects are obtained by the present invention, including the equaling of tensions and stresses that otherwise serve to distort the fabrics and hat as a whole when adjusted as would be the situation with the embodiment of the parent application. Such problems are magnified for the preferred embodiment of a substantially flat top, but with the present invention are obviated.

It is within the scope of the invention to make variations and modifications and substitution of equivalents as would be apparent to a person of ordinary skill.

I claim:

1. An adjustable-fit head covering having a crown and an elongated supporting band therefor having first and second band ends and having an upper band edge and the supporting band adapted to be turned inwardly as an inner supporting band, the crown including a top portion with top circumscribing edges and an elongated supporting circumscribing rim having upper and lower rim edges with the top circumscribing edges mounted on and along said upper rim edge, and said upper band edge being mounted on and along said lower rim edge with said first and second band ends forming a gap therebetween, said rim including a gap-positioned first rim portion in juxtaposition to said gap, and said rim including a remaining rim portion that is positioned away from said gap, said first rim portion including an intermediate rim portion and at-least two opposite direction-directed separate first and second spaced-apart reverse-direction means for obtaining equalized stresses on said rim and said top portion when adjusting crown wearing size, each of said reverse-direction means having first and second reverse-direction ends having first and second inwardly-directed surfaces thereof, with the first reverse-direction end mounted on said first rim portion and with the second reverse-direction end of each of said first and second spaced-apart reverse-direction means at spaced-apart locations at opposite sides of said gap adjoining said remaining rim portion, each of said first and second spaced-apart reverse-direction means being for hinge-like serially folding the annular rim structure upon itself in opposite directions at spaced-apart predetermined optionally alternate locations such that for each of said first and second spaced-apart reverse-direction means said first inwardly-directed surface is movable at-least partially to or from face-to-face juxtaposition to one-another when wearing size of the crown is optionally folded or unfolded to fit alternate sizes of heads, and a first and at-least two second mating means for detachably mating of the first mating means with the two second mating means for detachably mating with said first mating means, the first and second mating means being jointly for intermittently detachably securing said first and second band ends together after said supporting band has been turned-under said rim portion as said inner supporting band, the first mating means being positioned and mounted on said intermediate portion and one of said second mating means being mounted on said first band end and a remaining other second mating means being mounted on said second band end such that said first mating means is intermittently detachably matable with each of the two second mating means when said supporting band is inwardly turned to its rim-supporting position whereby the crown is securable at any of alternate head sizes when adjusted by either or both of said first and second spaced-apart reverse-direction means and whereby opposite sides of the crown may be evenly stretched and positioned to secure improved fitting and appearance when worn.

2. The adjustable fit head covering of claim 1, in which said gap-positioned rim portion has a first inwardly-facing surface relative to said crown and said remaining portion has a second inwardly-facing surface relative to said crown, and said first and second inwardly-facing surfaces being at-least in-part in face-to-face opposing contact when at-least one of said first and second spaced-apart reverse-direction means is folded such that a gap-positioned rim portion at-least in-part overlaps said remaining rim portion.

3. The adjustable fit head covering of claim 1, including a continuing line of junction of said flat top portion and said upper rim edge and including on opposite sides of said line of junction, spaced-apart parallel stitching having separate stitching such that said flat top portion and rim portion retain predetermined supported shape and position before and after and during adjustments of head-size by alternate positioning during use of said first and second mating means.

4. The adjustable fit head covering of claim 3, in which said intermediate rim portion has first and second lateral edges and opposite intermediate-portion inner and outer faces thereof, with the first lateral edge joining one of said second reverse-direction ends and with the second lateral edge joining a remaining other of said second reverse-direction ends.

5. In a head covering adjustable to fit heads of different sizes, of which the head covering includes a crown having a substantially flat top portion and having a substantially separate upright annular supporting rim portion, and having an inwardly-foldable hat band portion supportable of the rim portion when folded inwardly, an improvement comprising in combination: said rim portion forming a substantially annular rim structure having rim substantially continuous material with the rim portion including forward, rearward and opposite lateral rim portions having a common circumscribing substantially annular lower rim edge to the annular structure and a common opposite-circumscribing substantially annular upper rim edge to the annular structure, with the flat top portion mounted on said opposite-circumscribing annular upper rim edge, and the rim portion having opposite inner and outer rim faces; the hat band having opposite elongated upper and lower band edges, having opposite first and second band ends and having opposite inner and outer band faces, with said elongated upper band edge mounted on said circumscribing annular lower rim edge along said forward and opposite lateral rim portions and mounted along less than all of said rearward rim portion such that there is left a band gap between said band opposite ends, and the hat band adapted to be turned inwardly as an inner supporting band with said inner band face directed outwardly toward said inner rim face, said band gap being located adjacent said rim substantially continuous material, the rim portion including a gap rim portion adjacent said gap and remaining other rim portion, said gap portion having its said lower rim edge adjacent said gap, said substantially annular rim structure including two separate first and second spaced-apart reverse-direction means each having first and second reverse-direction ends and the first reverse-direction end of each of said first and second spaced-apart reverse-direction means at spaced-apart locations at opposite sides of said gap, adjoining said remaining rim portion, and an intermediate rim portion having opposite rim portion first and second lateral edges and opposite intermediate-portion inner and outer faces thereof, with the first lateral edge joining one of said second reverse-direction ends and with the second lateral edge joining a remaining other of said second reverse-direction ends, each of said first and second spaced-apart reverse-direction means being for hinge-like consecutively at spaced-apart predetermined optionally alternate locations folding the annular rim structure upon itself such that wearing size of the crown may be optionally folded to fit alternate sizes of heads, and a first and at-least two second mating means for detachably mating of the first mating means with the two second mating means, the first mating means having a first mating face, each second mating means having a second mating face, the first mating means being positioned and mounted on said intermediate portion positioned and one of said second mating faces being mounted on said first band end and a remaining other second mating faces being mounted on said second band end such that said first mating means is intermittently detachably matable with each of the two second mating means when said band portion is inwardly turned to its rim-supporting position whereby the crown is securable at any of alternate head sizes when adjusted by either or both of said first and second spaced-apart reverse-direction means and whereby opposite sides of the crown may be evenly stretched and positioned to secure improved fitting and appearance when worn.

6. The improvement of claim 5, in which one of said first and second mating means includes loop-like elements, and the remaining one of said first and second mating means includes hook-like elements detachably adapted for hooking into said loop-like elements.

7. The improvement of claim 6, including a visor element attached fixedly to and extending from said lower rim edge.

8. The improvement of claim 7, in which one of said first and second mating means includes loop-like elements, and the remaining one of said first and second mating means includes hook-like elements detachably adapted for hooking into said loop-like elements.

9. The improvement of claim 6, including the rim portion being folded in a reverse direction onto itself and secured in a reverse-direction folded state.

10. The improvement of claim 9, including a continuing line of junction of said flat top portion and said opposite-circumscribing annular upper rim edge and including on opposite sides of said line of junction, spaced-apart parallel stitching having separate stitching such that said flat top portion and rim portion retain predetermined supported shape and position before and after and during adjustments of head-size by alternate positioning during use of said first and second mating means.

11. The improvement of claim 5, including a continuing line of junction of said flat top portion and said opposite-circumscribing annular upper rim edge and including on opposite sides of said line of junction, spaced-apart parallel stitching having separate stitching such that said flat top portion and rim portion retain predetermined supported shape and position before and after and during adjustments of head-size by alternate positioning during us of said first and second mating means.

12. The improvement of claim 11, in which one of said first and second mating means includes loop-like elements, and the remaining one of said first and second mating means includes hook-like elements detachably adapted for hooking into said loop-like elements.

* * * * *